US006173838B1

(12) United States Patent
Brozell

(10) Patent No.: US 6,173,838 B1
(45) Date of Patent: Jan. 16, 2001

(54) CHILD-RESISTANT MEDICATION COMPACT

(75) Inventor: Brian J. Brozell, Toledo, OH (US)

(73) Assignee: Owens Illinois Closure Inc., Toledo, OH (US)

( * ) Notice: Under 35 U.S.C. 154(b), the term of this patent shall be extended for 0 days.

(21) Appl. No.: 09/495,272

(22) Filed: Jan. 31, 2000

(51) Int. Cl.[7] ..... B65D 83/04

(52) U.S. Cl. ..... 206/538; 206/472; 220/326; 220/839

(58) Field of Search ..... 206/528, 530, 206/531, 532, 538, 539, 525, 472, 232, 1.5; 220/324, 326, 836, 837, 839; 402/31, 39

(56) References Cited

U.S. PATENT DOCUMENTS

| | | | | |
|---|---|---|---|---|
| 3,552,595 | * | 1/1971 | Gerner et al. | 206/539 |
| 3,954,179 | * | 5/1976 | Warmath | 206/528 |
| 4,998,623 | * | 3/1991 | Doull | 206/531 |
| 5,265,728 | * | 11/1993 | Allendorf et al. | 206/531 |
| 5,272,832 | | 12/1993 | Marshall et al. . | |
| 5,346,069 | * | 9/1994 | Intini | 206/531 |
| 5,348,158 | * | 9/1994 | Honan et al. | 206/531 |
| 5,531,322 | * | 7/1996 | Iwaki et al. | 206/472 |
| 5,740,938 | | 4/1998 | Hofman et al. . | |
| 6,021,901 | * | 2/2000 | Wolfe | 206/531 |

* cited by examiner

*Primary Examiner*—Luan K. Bui

(57) ABSTRACT

A compact (10) securely engaging an edge of a blister card (60) with a multiplicity of items (62) separately packaged thereon. The compact, which is formed from a molded blank (12) of a thermoplastic material, has first and second generally planar members (20, 22) separated from one other by parallel, generally rectangular portions or strips (24, 30) that are defined by three spaced apart fold lines (14, 16, 18). The generally rectangular strips are foldable about the centrally located of the fold lines (14) to overlie one another and to engage an edge of the blister card, and are locked in such overlying positions by engagement of locking posts (26, 28) on one of the strips with recesses (32, 34) on the other of the strips. Opposed ends of the compact have locking tabs (40, 42) that are received in recesses (44, 46) in a closed position of the compact, and these locking tabs must be simultaneously manually engaged to permit the compact to be opened. Further, a front edge of the compact, which extends between its opposed ends, has a latch (48) that must be manually depressed from engagement with a tab (50) by a second hand of a user simultaneously with manual engagement of the locking tabs (50) before the compact can be opened, which, in combination with the locking tabs, imparts child-resistant opening characteristics to the compact.

10 Claims, 6 Drawing Sheets

CHILD-RESISTANT MEDICATION COMPACT

BACKGROUND OF THE INVENTION

1. Field of the Invention

This invention relates to a compact or container for containing a blister card having a multiplicity of individual doses of a medication. More particularly, this invention relates to a compact or container of the foregoing character that has child-resistant opening characteristics.

2. Description of the Prior Art

Many medications are now packaged in blister cards, each of which has a multiplicity of individually removable pills, tablets, capsules or other discrete forms of the medication. For the convenience of the user, it is desirable to package the blister card in an outer container, and the configuration of a typical blister card indicates that the outer container should have the characteristics of a compact of the type used in packaging face powder and other cosmetic products, that is, a container with clam shell-like opening and closing characteristics, and it is also important, in the packaging of many types of medications, that the outer container have child-resistant opening characteristics. U.S. Pat. No. 5,740,938 (Hofmann et al.) describes a package with the foregoing characteristics.

An important functional requirement of medication compacts of the type described that is not met by the aforesaid '948 patent, however, is that the compact be able to securely engage the blister card contained therein to prevent disengagement of the entire blister card upon opening of the compact for the purpose of removing only a single dose of the medication contained therein.

SUMMARY OF THE INVENTION

A medication compact according to the present invention is formed in a single piece from a suitable thermoplastic material, such as polypropylene, in sheetlike form. The compact has upper and lower cup-shaped compartments that are foldable with respect to one another between a closed position, in which a blister card contained in the compact is entirely encased, and an open position, in which access is provided to the blister card to permit a user to remove a dose of a medication packaged thereon. Child-resistant opening characteristics are provided to the package by providing an opposed pair of flexible locking tabs at opposed ends of the compact that must be simultaneously deflected from their locking positions before the upper and lower compartments can be moved from their closed positions to their open positions, and preferably these locking tabs are spaced far enough from one another that an adult, but not a child, can simultaneously engage them with only one hand. A further child-resistant locking feature is provided in the form of a flexible latch at the front of the compact, along an axis that extends transversely of the axes along which the locking tabs lie. This latch must be deflected from its latching position when the locking tabs are deflected from their locking positions, thus requiring the use of both hands of the user in the opening of the compact, to thereby impose a major obstacle to the opening of the compact by children that will not also serve as even a minor obstacle to the opening of the package by adults with unimpaired hand function.

Permanent retention of the blister card by a compact according to the present invention is obtained by providing the compact with three spaced apart fold lines, or hinges, extending centrally of the compact along axes extending parallel to the flexible latch at the front of the compact. One or more locking posts are provided in a space between the central fold line and an outer fold line, and one or more locking post receiving recesses are provided in a space between the central fold line and the other outer fold line. A free edge of the blister card is inserted to overlie the locking posts and the locking post receiving recesses while the compact is fully open, and then the portions of the compact on opposite sides of the central fold line are folded about the central fold line to bring the locking posts into locking engagement with the locking post receiving openings, through aligned openings in the blister card, thereby permanently securing the blister card within the compact. Thereafter, opening and closing of the compact occurs by folding the portions of the compact outside the outer fold lines with respect to one another about one or both of the outer fold lines.

Accordingly, it is an object of the present invention to provide an improved compact for packaging a blister card with a multiplicity of discretely packaged items thereon. More particularly, it is an object of the present invention to provide a compact of the foregoing character in which the discretely packaged items are individual doses of a medication and which has child-resistant opening characteristics. It is a further object of the present invention to provide a compact of the foregoing character that permanently engages the blister card to prevent its disengagement when the compact is open.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
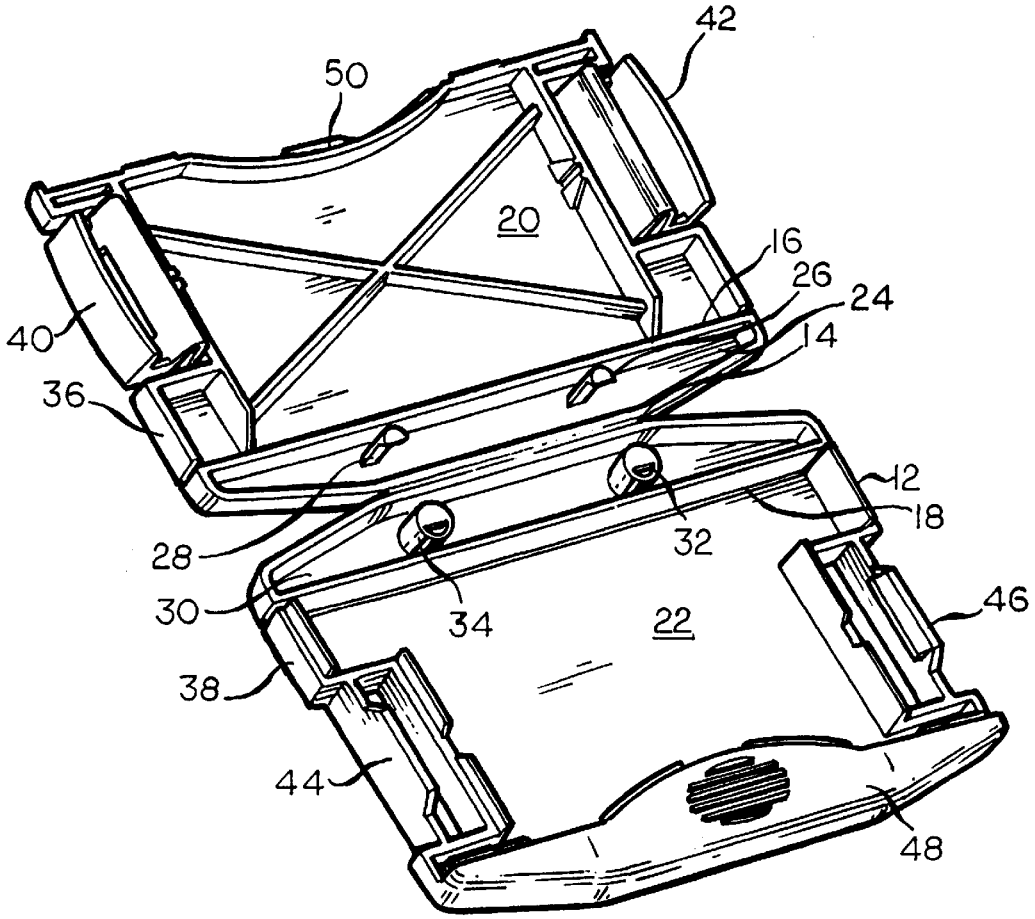
FIG. 1 is a plan view of a blank from which a compact according to the preferred embodiment of the present invention is formed.
Figure 5:
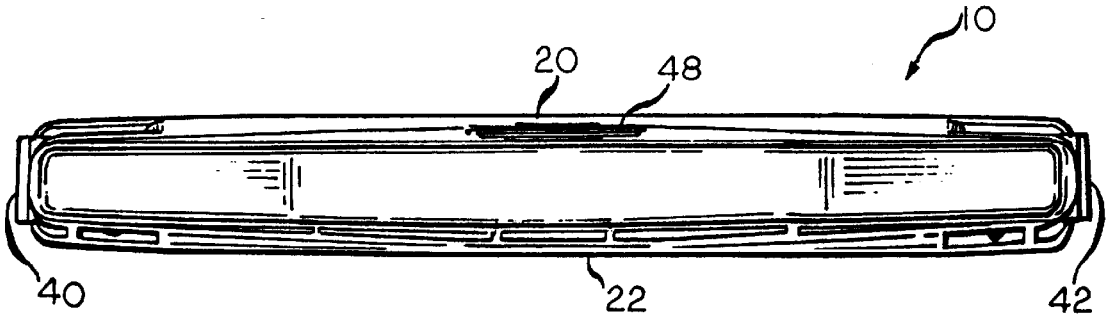
FIG. 5 is a front elevational view of the package of FIGS. 3 and 4.
Figure 2:
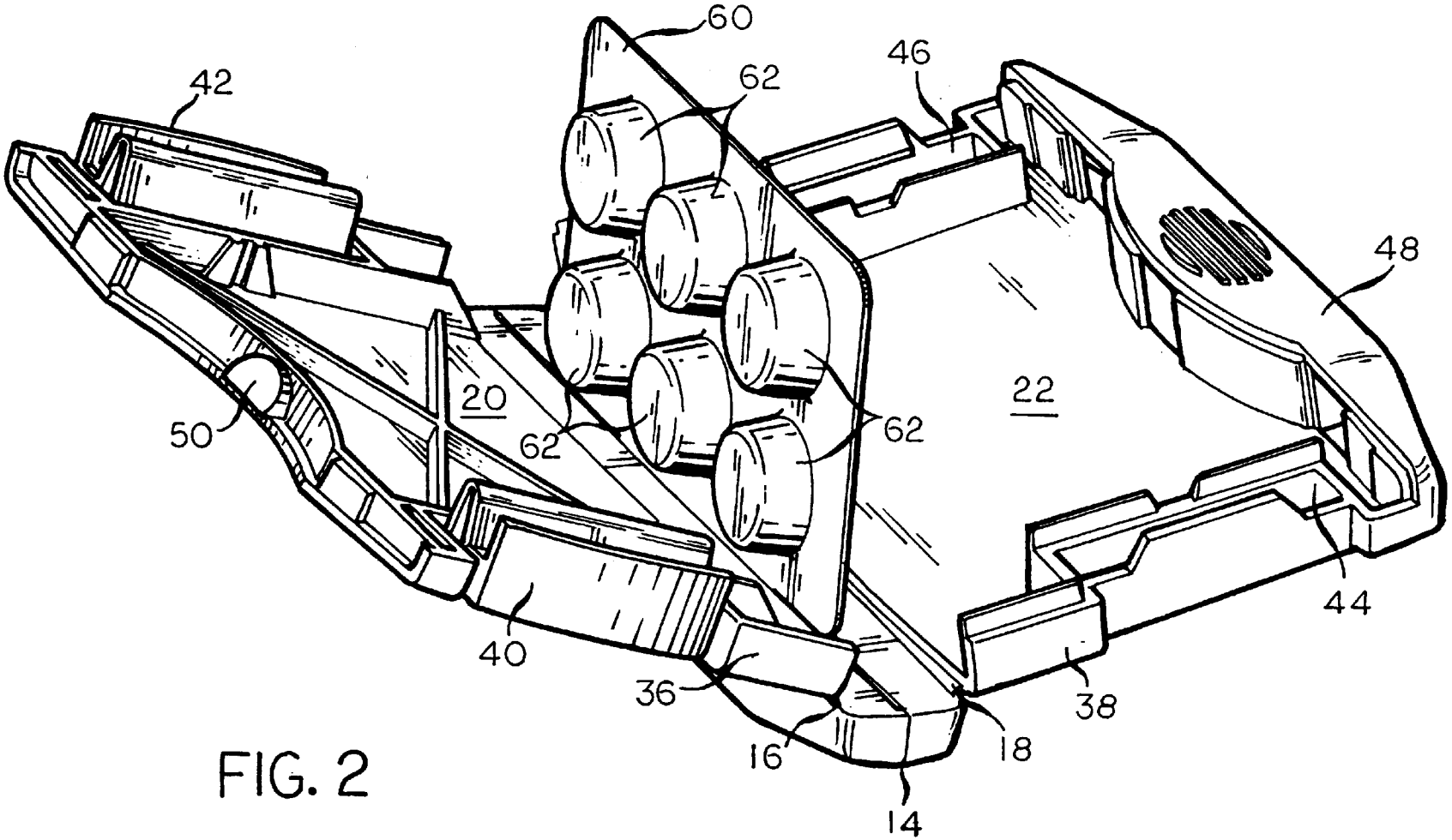
FIG. 2 is a perspective view illustrating a step in the assembly of a package from the blank of FIG. 1, FIG. 2 illustrating the assembly of a blister card with a plurality of individually packaged items in the compact being formed from the blank of FIG. 1.
Figure 3:
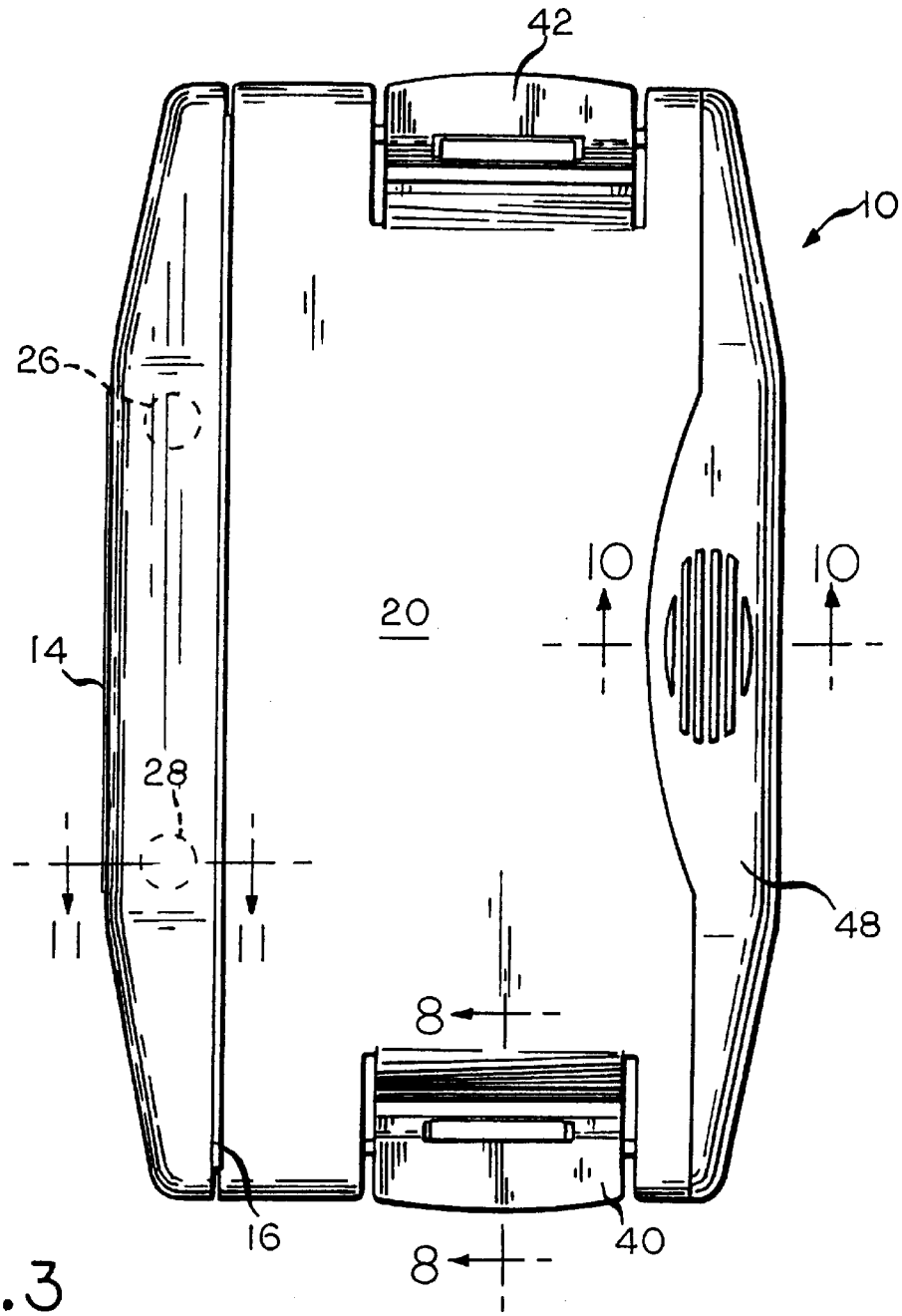
FIG. 3 is a top plan view of a package, in its closed condition, which is made up of a compact formed from the blank of FIG. 1 with a blister card of the type shown in FIG. 2 therein.
Figure 4:
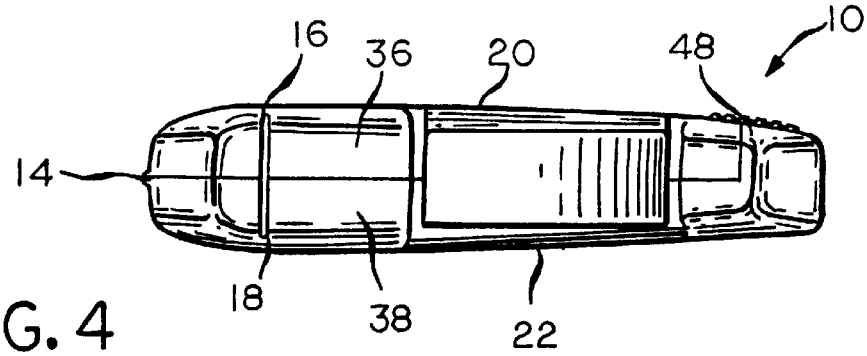
FIG. 4 is a side elevational view of the package of FIG. 3.

A compact according to the preferred embodiment of the present invention is indicated generally by reference numeral 10 in FIGS. 3–7, and is formed from a molded blank 12 (FIG. 1) of a generally rigid, thermoplastic material, such as polypropylene. The blank 12 has a centrally located fold line 14, and first and second outer fold lines 16, 18 on opposite sides of the fold line 14 and extending parallel thereto. The portions of the blank 12 outwardly of the fold lines 16, 18 define top and bottom portions 20, 22, respectively, of the compact 10, and the top and bottom portions 20, 22 are generally rectangular in configuration with major dimensions extending parallel to the fold lines 16, 18.

A portion or strip of the blank 12 between the fold line 16 and the fold line 14 is identified by numeral 24, and the portion 24 is provided with a spaced apart pair of upwardly extending locking posts 26, 28, which are molded integrally with the blank 12. A portion or strip of the blank 12 between the fold line 18 and the fold line 14 is identified by numeral 30, and the portion 30 is provided with a spaced apart pair of upwardly extending locking post receiving tubulations 32, 34, which are also molded integrally with the blank 12. Upon the folding of the portions 24, 30 of the blank 12 with respect to one another about the fold line 14, the locking posts 26, 28 are aligned with the tubulations 32, 34, respectively. Before inserting the locking posts 26, 28 into the tubulations 32, 34, an edge (not shown) of a blister card 60 is inserted between the portions 24, 30, and the locking posts 26, 28 are inserted, through the blister card 60, into the tubulations 32, 34 to permanently secure the blister card 60 within the compact 10. In that regard, the blister card 60 has a plurality of individually packaged items 62 thereon, which may be individually removed upon opening of the compact 10 without the risk of accidental or inadvertent disengagement of the blister card 60 from the compact 10. A package made up of the compact 10 and the blister card 60 is especially well suited for the packaging of items 62 in the form of pills, tablets, capsules or other discrete forms of individual doses of a medication, because of the known tamper-resistant properties of packaging such products on blister cards and the importance of packaging such products in a tamper-resistant manner.

Figure 6:
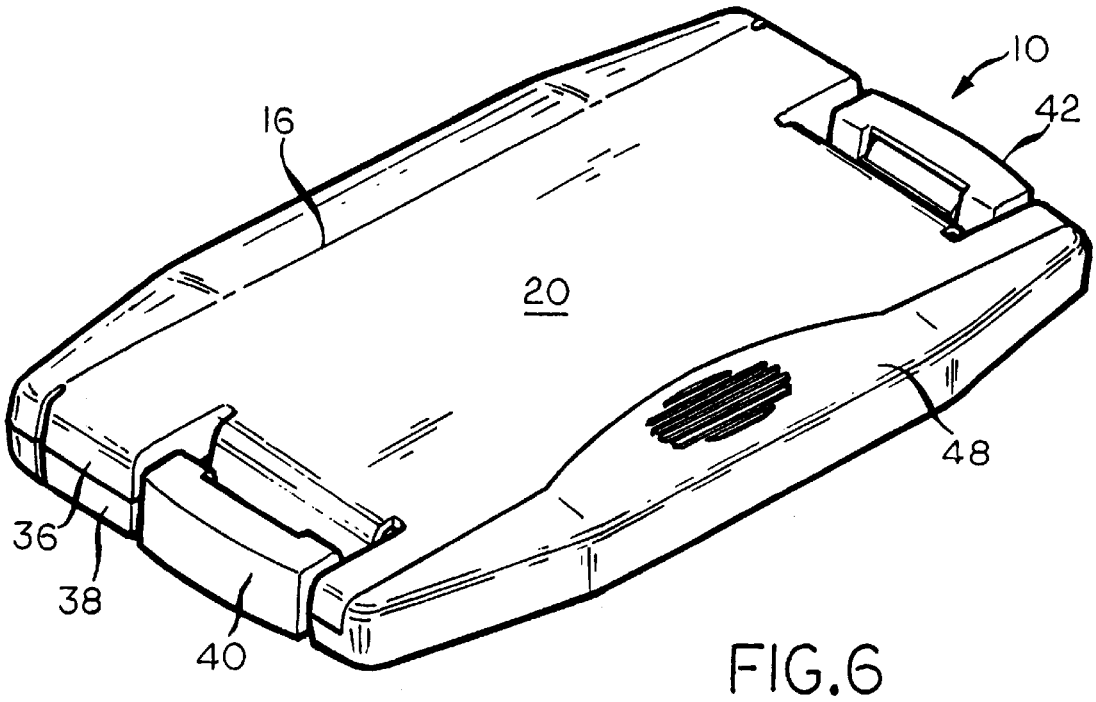
FIG. 6 is a perspective view taken from the top of the package of FIGS. 3–5.
Figure 7:
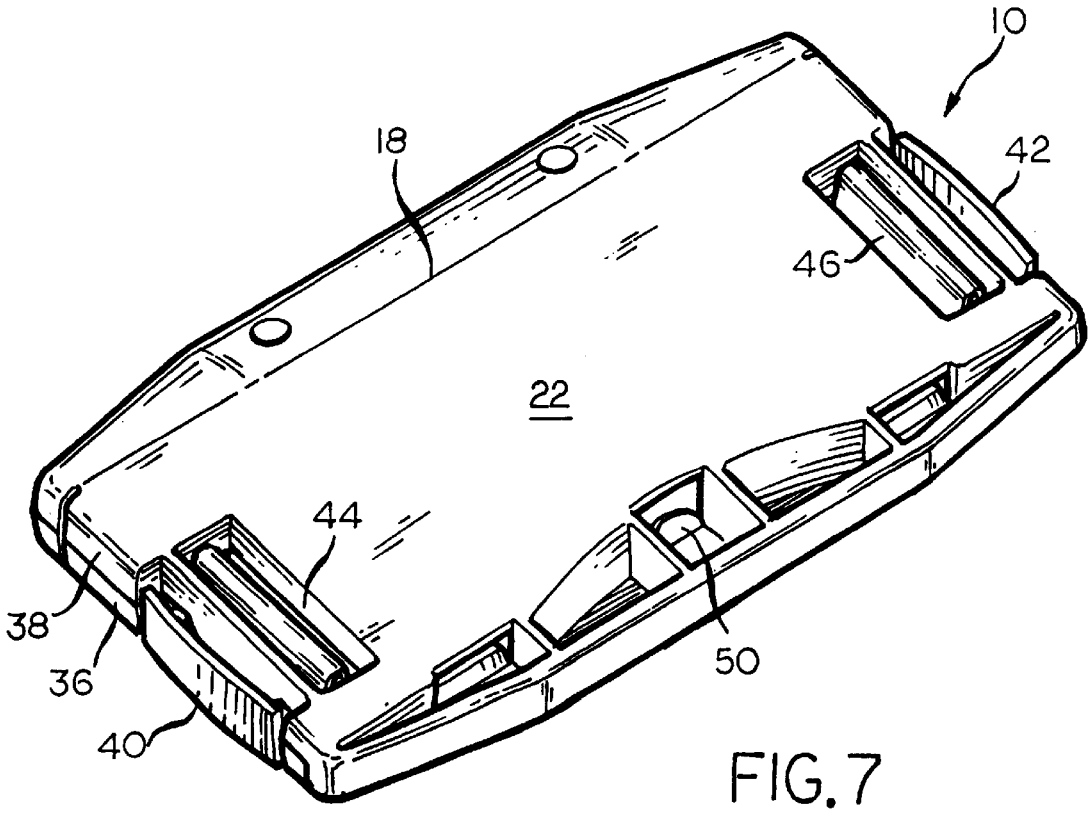
FIG. 7 is a perspective view taken from the bottom of the package of FIGS. 3–6.
Figure 9:
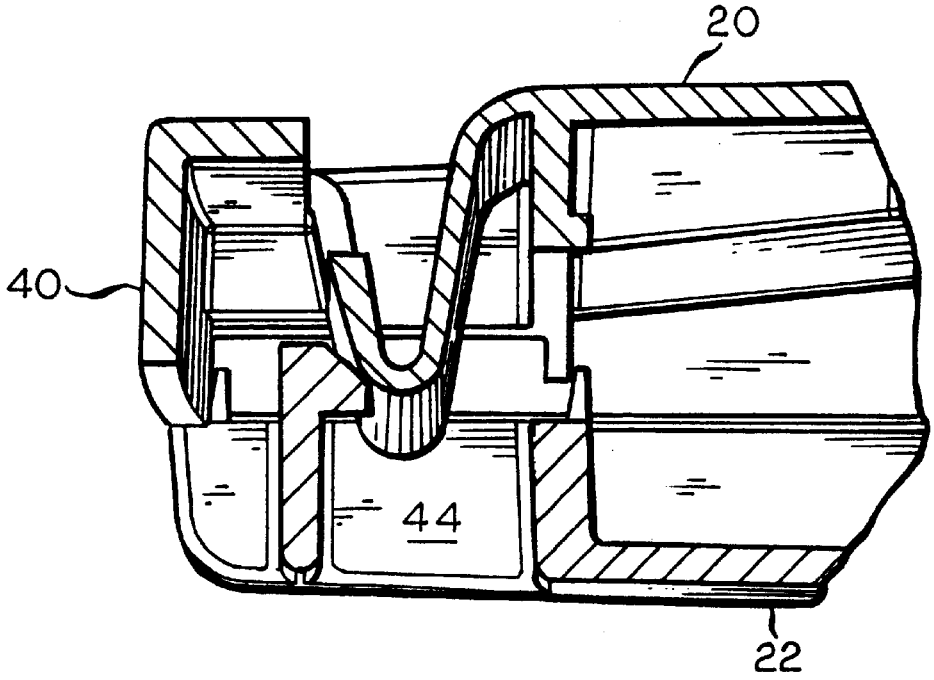
FIG. 9 is a view like FIG. 8 in which the elements of the package are shown in a partly open condition of the package.

The top 20 of the compact 10 has a shallow wall 36 on three of its sides, the opposed shorter sides extending away from the fold line 16 and a transverse side extending therebetween and opposed to the fold line 16, and the shallow wall 36, together with the portion 24 of the blank 12, circumscribes the top 20 to impart a generally cup-shaped configuration thereto. Likewise, the bottom 22 of the compact 10 has a shallow wall 38 on three of its sides, the opposed shorter sides extending away from the fold line 18 and a transversely extending side extending therebetween and opposed to the fold line 18, and the shallow wall 38, together with the portion 30 of the blank 12, subscribes the bottom 20 to impart a generally cup-shaped configuration thereto. Thus, when the compact 10 is closed, for example, as is shown in FIGS. 6 and 7, its contents are totally surrounded and inaccessible without positively opening the compact 10.

Figure 8:
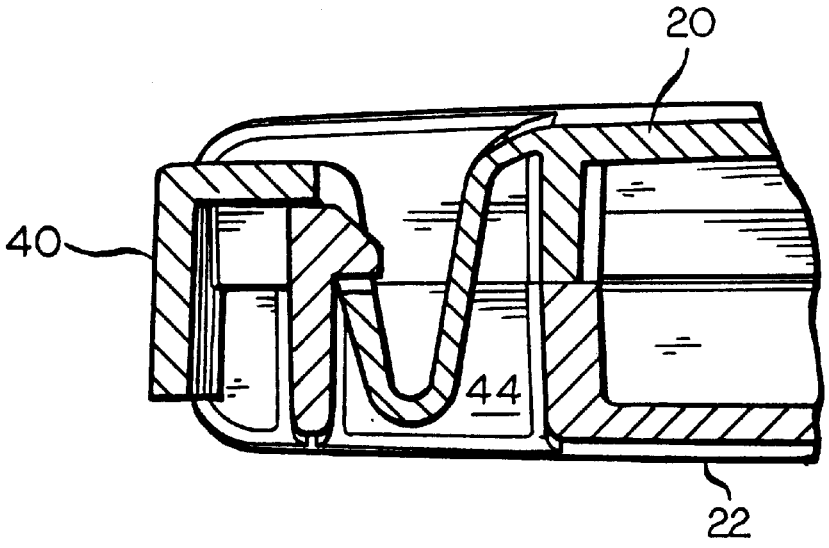
FIG. 8 is a fragmentary sectional view, at an enlarged scale, taken on line 8—8 of FIG. 3, in which the elements are shown in the closed condition of the package.

Child-resistant opening characteristics are imparted to the compact 10 partly by providing flexible locking tabs 40, 42 to opposed ends of one or another of the top 20, bottom 22 of the compact 10, preferably and as shown, the top 20 of the compact 10. The locking tabs 40, 42 are preferably spaced sufficiently closely to one another to be simultaneously graspable in a single hand of an adult, but sufficiently far apart not to be simultaneously graspable in a single hand of a child, and a spacing of approximately four inches has been found to be suitable to achieve both such objectives. In any case, the locking tabs 40, 42 of the top 20 frictionally engage locking tab recesses 44, 46, respectively, in the bottom 22 of the compact 10 in the closed condition of the compact 10, as is shown most clearly in FIG. 8 in reference to the locking tab 40. Thus, the locking tabs 40, 42 must be simultaneously inwardly deflected by hand action to permit their disengagement from the recesses 44, 46, respectively, to thereby permit the opening of the compact 10. In any case, the locking tabs 40, 42 have sufficient rigidity to return to their original, recess-engaging positions upon removal of hand load therefrom, until the compact 10 is again closed, whereupon the closing action will bring the locking tabs 40, 42 back into their recess-engaging locking positions.

Figure 10:
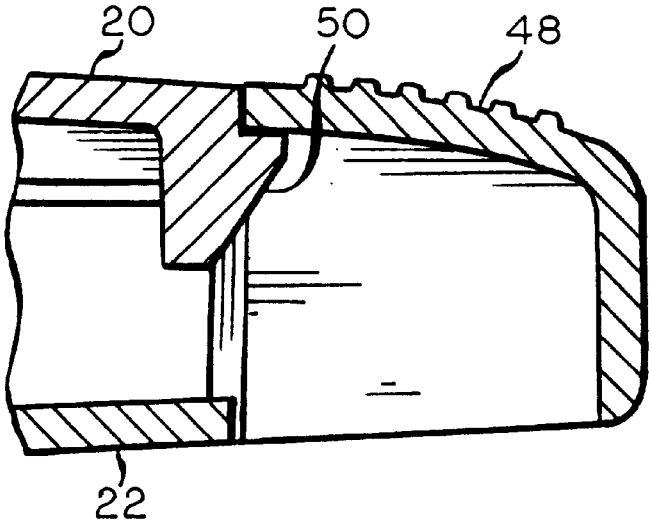
FIG. 10 is a fragmentary sectional view, at an enlarged scale, taken on line 10—10 of FIG. 3.
Figure 11:
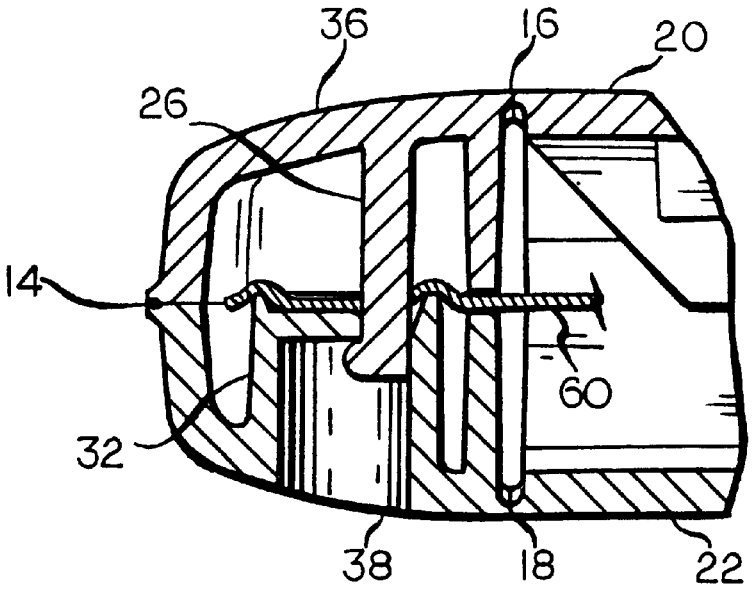
FIG. 11 is a fragmentary sectional view, at an enlarged scale, taken on line 11—11 of FIG. 3.

Further child-resistant opening characteristics are imparted to the compact 10 by providing a flexible latch 48 to one or another of the top 20, bottom 22 of the compact 10, preferably and as shown, the bottom 22 of the compact 10. The latch 48 extends inwardly from the front of the compact 10, that is, the side extending between the locking tabs 40, 42 and opposed to the fold line 18, and the latch 48 is spaced from the inside of the top 22 and extends parallel thereto. In the closed position of the compact 10, the latch 48 engages a tab 50 in the wall 36 of the top 20, as is shown most clearly in FIG. 10, and the compact 10 cannot be opened until the latch 48 is manually depressed to disengage from the tab 50, and this must also be simultaneously with the inward deflection of each of the locking tabs 40, 42. Thus, as described, the compact 10, when closed, can only be opened with a two-handed opening action, and this provides effective child-resistant opening characteristics to the compact 10.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A compact for containing a blister card having a plurality of products packaged thereon, said compact comprising:

a first generally planar member;

a second generally planar member formed integrally in a single piece with said first generally planar member;

three spaced apart fold lines separating said first and second generally planar members and defining first and second strips therebetween, said first and second generally planar members being foldable with respect to one another about at least one of said spaced apart fold lines at a location external to said first and second strips, said first and second strips being adapted to securely engage an edge of the blister card in a first relative position of said first and second strips where said first and second strips overlie one another; and means extending between said first and second strips for securely retaining said first and second strips in said first relative position of said first and second strips.

2. A compact according to claim 1 wherein each of said first and second generally planar members is generally rectangular in configuration, and further comprising:

first hand engagable means opposed to said one of said fold lines for releasably joining said first and second generally planar members to one another in a closed position of said compact.

3. A compact according to claim 2 and further comprising:

second and third means engageable by another hand on opposed ends of said compact, said opposed ends extending transversely to said one of said fold lines, for releasably joining said first and second generally planar members to one another.

4. A compact according to claim 1 wherein said single piece is formed from a molded blank of thermoplastic material.

5. A package comprising:

a compact comprising;

a first generally planar member;

a second generally planar member formed integrally in a single piece with said first generally planar member;

three spaced apart fold lines separating said first and second generally planar members and defining first and second strips therebetween, said first and second generally planar members being foldable with respect to one another about at least one of said spaced apart fold lines at a location external to said first and second strips;

a blister card having a plurality of products packaged thereon, an edge of said blister card being trapped between said first and second strips when said first and second strips have been folded to overlie one another about said one of said spaced apart fold lines;

said compact further comprising:

means for securely retaining said first and second strips in position overlying one another with said edge of said blister card trapped therebetween.

6. A package according to claim 5 wherein each of said first and second generally planar members of said compact is generally rectangular in configuration, and wherein said compact further comprises:

first means engagable by a hand opposed to said one of said fold lines of said compact for releasably joining said first and second generally planar members of said compact to one another in a closed position of said compact.

7. A package according to claim 6 wherein said compact further comprises:

second and third means engagable by another hand on opposed ends of said compact, said opposed ends of said compact extending transversely to said one of said fold lines of said compact, for releasably joining said first and second generally planar members of said compact to one another.

8. A package according to claim 5 wherein said single piece of said compact is formed from a molded blank of thermoplastic material.

9. A package according to claim 5 wherein said means for securely retaining comprises:

a plurality of spaced apart locking posts extending transversely from one of said first and second strips; and a plurality of spaced apart locking post receiving tubulations extending transversely from the other of said first and second strips;

each of said locking posts being received in one of said locking post receiving tubulations when said first and second strips have been folded to overlie one another.

10. A package according to claim 5 wherein said means for securely retaining extends between said first and second strips.

* * * * *